US009925582B2

(12) United States Patent
Yanagiya et al.

(10) Patent No.: US 9,925,582 B2
(45) Date of Patent: Mar. 27, 2018

(54) METHOD FOR CONTINUOUSLY CASTING SLAB CONTAINING TITANIUM OR TITANIUM ALLOY

(71) Applicant: Kobe Steel, Ltd., Kobe-shi (JP)

(72) Inventors: Kazuyuki Yanagiya, Takasago (JP); Eisuke Kurosawa, Kobe (JP); Takehiro Nakaoka, Kobe (JP); Hidetaka Kanahashi, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 15/450,420

(22) Filed: Mar. 6, 2017

(65) Prior Publication Data

US 2017/0282240 A1 Oct. 5, 2017

(30) Foreign Application Priority Data

Apr. 1, 2016 (JP) ..... 2016-074216

(51) Int. Cl.

| | |
|---|---|
| ***B22D 11/00*** | (2006.01) |
| ***B22D 11/11*** | (2006.01) |
| ***B22D 41/015*** | (2006.01) |
| ***B22D 11/04*** | (2006.01) |
| ***B22D 11/041*** | (2006.01) |
| ***B22D 21/00*** | (2006.01) |
| ***F27D 11/08*** | (2006.01) |

(52) U.S. Cl.

CPC ..... *B22D 11/0408* (2013.01); *B22D 11/001* (2013.01); *B22D 11/041* (2013.01); *B22D 11/11* (2013.01); *B22D 21/005* (2013.01); *B22D 41/015* (2013.01); *F27D 11/08* (2013.01)

(58) Field of Classification Search

CPC ... B22D 11/00; B22D 11/001; B22D 11/0408; B22D 11/041; B22D 11/10; B22D 11/11; B22D 21/005; B22D 41/015

See application file for complete search history.

(56) References Cited

U.S. PATENT DOCUMENTS 3,342,250 A * 9/1967 Treppschuh ..... B22D 11/00 164/258
3,894,573 A * 7/1975 Paton ..... C22B 9/226 164/469

(Continued)

FOREIGN PATENT DOCUMENTS

JP 2013-107130 A 6/2013
JP 2014-233753 A 12/2014
WO WO -2014115822 A1 * 7/2014 ..... B22D 11/041

*Primary Examiner* — Kevin E Yoon
(74) *Attorney, Agent, or Firm* — Oblon, McClelland, Maier & Neustadt, L.L.P.

(57) ABSTRACT

The present invention provides a method for casting a slab having a good cast surface. The method includes heating the surface of molten metal on a metal inlet side of a mold by a first heat source so that the following formulas: $q \geq 0.87$ and $c \leq 11.762q+0.3095$ are satisfied where c is a cycle time [sec] of turning movement of the first heat source, and q is an average amount of heat input [$MW/m^2$] determined by accumulating an amount of heat input applied by at least the first heat source to the contact region between the upper surface of the slab on the metal inlet side and the mold, along the path of turning movement of the first heat source, and dividing the resultant accumulated value by the cycle time c.

3 Claims, 13 Drawing Sheets

(56) References Cited

U.S. PATENT DOCUMENTS

| | | | | |
|---|---|---|---|---|
| 2013/0327493 | A1* | 12/2013 | Oda | B22D 11/124<br>164/512 |
| 2014/0360694 | A1* | 12/2014 | Nakaoka | B22D 11/001<br>164/469 |
| 2015/0306660 | A1* | 10/2015 | Kurosawa | B22D 11/041<br>164/468 |

* cited by examiner

TEAR DEFECTS

METHOD FOR CONTINUOUSLY CASTING SLAB CONTAINING TITANIUM OR TITANIUM ALLOY

BACKGROUND OF THE INVENTION

Field of the Invention

The present invention relates to a method for continuously casting a slab containing titanium or a titanium alloy.

Description of the Related Art

An ingot has been continuously cast by melting metal by vacuum arc or electron beam, and pouring the metal into an open mold where the metal is solidified and withdrawn from the bottom of the mold.

An ingot containing titanium or a titanium alloy is continuously cast while the surface of the molten metal in the mold is heated by plasma arc or electron beam.

If an excessively high heat input is applied to the surface of the molten metal in the mold, a solidified shell does not grow sufficiently and becomes excessively thin. Thus, when the solidified metal is withdrawn, the surface of the solidified shell is torn off due to lack of strength, which leads to an accident such as bleed-out. In contrast, if an excessively low heat input is applied to the surface of the molten metal in the mold, a solidified shell is overgrown, resulting in lapping of the molten metal. This leads to a large surface defect and makes it impossible to assure a sufficient molten metal pool, which precludes continuous casting. Thus, the amount of heat input should be in a proper range for good cast surface quality.

When a slab having a rectangular cross-section is continuously cast, there is a limit to the size of a chamber for accommodating a casting machine, and the molten metal is typically poured from a hearth into a mold through one of the paired shorter sides of the rectangular mold. However, the flow and the temperature of the molten metal create a difference in the temperature of a region near the surface of the molten metal between the metal inlet side and the side opposite the metal inlet side, and heat input is applied circumferentially non-uniformly. As a result, the solidification varies with circumferential position in a slab, which degrades the cast surface quality of the resulting slab.

A slab with poor cast surface quality requires removal of surface flaws before rolling, causing problems such as decreased yield and increased operations, which are responsible for increased cost. Thus, there exists a need for casting a slab with its cast surface having minimum irregularities and flaws.

JP 2013-107130 A discloses a method for casting a titanium slab to be hot rolled, the method including pouring molten metal simultaneously from the both walls on the paired shorter sides of a mold. Pouring of molten metal simultaneously from the both walls on the paired shorter sides ensures uniform temperature of the molten metal in the mold along the length of the mold walls on the opposing longer sides, which suppresses deformation (warpage) in the thin thickness direction. The temperature is also uniform along the length of the mold walls on the opposing shorter sides, which can further inhibit deformation (bending) in the width direction.

JP 2014-233753 A discloses a method for melting and re-solidifying the surface of an ingot prepared by casting the ingot and cold-working the surface layer of the ingot or only by melting metal and casting the ingot. Melting and re-solidification of only the surface layer of an ingot allows provision of a pure titanium ingot for industrial use with decreased surface flaws and good surface quality.

Problems to be Solved by the Invention

However, in the method in JP 2013-107130 A, it is necessary to provide a hearth on each of the paired shorter sides of the mold, which increases the size of the chamber. The increased number of hearths also increases the number of heat sources for heating molten metal in the hearths, which increases production costs. In the method in JP 2014-233753 A, a re-melting process is added, which increases production costs. From the standpoint of suppressing the production cost, it is preferred to pour molten metal from one of the paired shorter sides of a mold. It is also preferred to allow rolling of a cast slab with no additional process.

The inventors thought that when molten metal is poured from one of the paired shorter sides of a rectangular mold, a surface region of molten metal on the metal inlet side, the region not only being heated by heat sources but also receiving the molten metal, would have a higher temperature than the temperature of a surface region on the side opposite the metal inlet side, the region being only heated by the heat sources. However, study of the cast surface quality of a cast slab has revealed that a surface region on the metal inlet side exhibited poorer cast surface quality than a surface region on the side opposite the metal inlet side. The inventors have found that this is due to the fact that a surface region on the metal inlet side has a temperature lower than the temperature of a surface region on the side opposite the metal inlet side.

The surface of the molten metal in the mold has a temperature of 2000° C. or higher at the positions heated by heat sources. The surface of the molten metal on the side opposite the metal inlet side has an average temperature from 1900° C. to 2000° C. In contrast, molten metal poured through a pouring lip of the hearth into the surface of the molten metal in the mold is presumed to have a temperature near the melting point of molten titanium or a molten titanium alloy (in the case of pure titanium, the melting point is about 1680° C.), because a thick solidified layer is formed around the periphery of the pouring lip. The surface of the molten metal in the hearth has an average temperature from 1900° C. to 2000° C. However, the pouring lip of the hearth has a narrow width and high cooling ability. Thus, when the molten metal is passed through the pouring lip, the temperature of the metal is decreased to around the melting point.

Then, the surface of the molten metal in the mold on the metal inlet side receives the molten metal having a temperature lower than the average temperature of the surface of the molten metal on the side opposite the metal inlet side, and thus the surface on the metal inlet side has an insufficient heat input. As a result, a solidified shell grows more quickly on the surface of the molten metal along the longer sides of the mold especially on the metal inlet side, whereby the cast surface quality degrades.

It is an object of this invention to provide a method for continuously casting a slab containing titanium or a titanium alloy and having a good cast surface.

Means of Solving the Problems

The present invention provides a method for continuously casting a slab containing titanium or a titanium alloy by pouring molten metal formed by melting titanium or a titanium alloy into an open mold having a rectangular cross-section where the molten metal is solidified and withdrawn from the bottom of the mold. The method includes a step of pouring the molten metal into the mold from one of the paired shorter sides of the mold, and a step of dividing, in a direction of longer sides of the mold, a surface of the molten metal in the mold into a melt inlet side, where the molten metal is poured, and a side opposite the metal inlet side, heating the surface of the molten metal on the metal inlet side of the mold by a first heat source, which is configured to turn in a horizontal plane over the surface of the molten metal on the metal inlet side and heating the surface of the molten metal on the side opposite the metal inlet side by a second heat source, which is configured to turn in a horizontal plane over the surface of the molten metal on the side opposite the metal inlet side. The method is characterized in that the surface of the molten metal on the metal inlet side is heated by the first heat source in the heating step so that the following formulas: $q \geq 0.87$ and $c \leq 11.762q+0.3095$ are satisfied, where c is a cycle time [sec] of turning movement of the first heat source, and q is an average amount of heat input [$MW/m^2$] determined by accumulating an amount of heat input, which is applied by at least the first heat source to a region of contact between an upper surface of the slab on the metal inlet side and the mold, along a path of turning movement of the first heat source, and dividing the resultant accumulated value by the cycle time c.

Effects of the Invention

According to the present invention, molten metal is poured into a mold from one of the paired shorter sides of the mold, and the surface of the molten metal on the metal inlet side is heated by a first heat source so that an average amount of heat input q [$MW/m^2$] satisfies the following formulas: $q \geq 0.87$ and $c \leq 11.762q+0.3095$, wherein the average amount of heat input q is determined from the cycle time c [sec] of turning movement of the first heat source and the amount of heat input, which is applied by the first heat source to a region of contact between the upper surface of a slab on the metal inlet side and the mold. Specific means for increasing the temperature of the surface of the molten metal on the metal inlet side can include increasing the output of the first heat source and changing the path and/or the rate of turning movement of the first heat source. When such measures are carried out, the temperature of the surface of the molten metal on the metal inlet side can be increased by satisfying the above heat input conditions. This reduces the difference in the temperature/the amount of heat input between the metal inlet side and the side opposite the metal inlet side, and thus the slab can have good cast surface quality over the entire longer side. Thus, the method according to the present invention can cast a slab having a good cast surface.

DESCRIPTION OF THE PREFERRED EMBODIMENTS

Now, a preferred embodiment of the present invention will be described with reference to the drawings.

(Configuration of Continuous Casting Machine)

A method for continuously casting a slab containing titanium or a titanium alloy according to the embodiment includes pouring molten metal formed by melting titanium or a titanium alloy into an open mold having a rectangular cross-section where the molten metal is solidified and withdrawn from the bottom of the mold.

Figure 1:
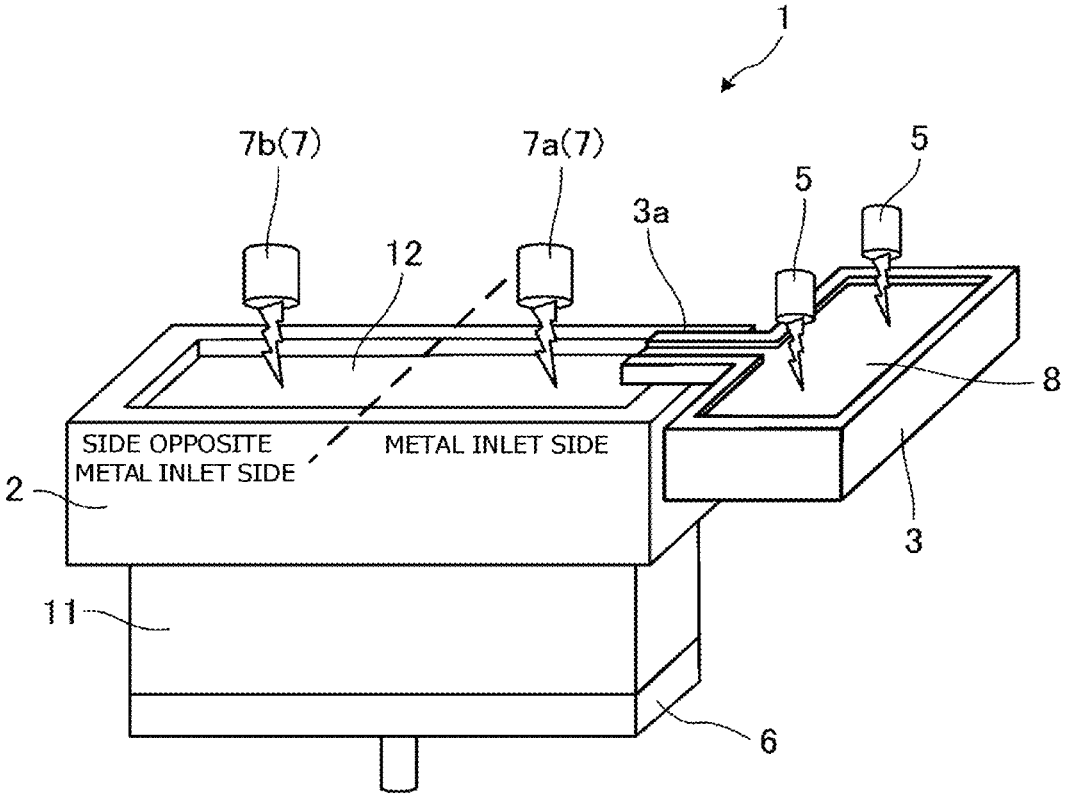
FIG. 1 is a perspective view of a continuous casting machine.
Figure 2:
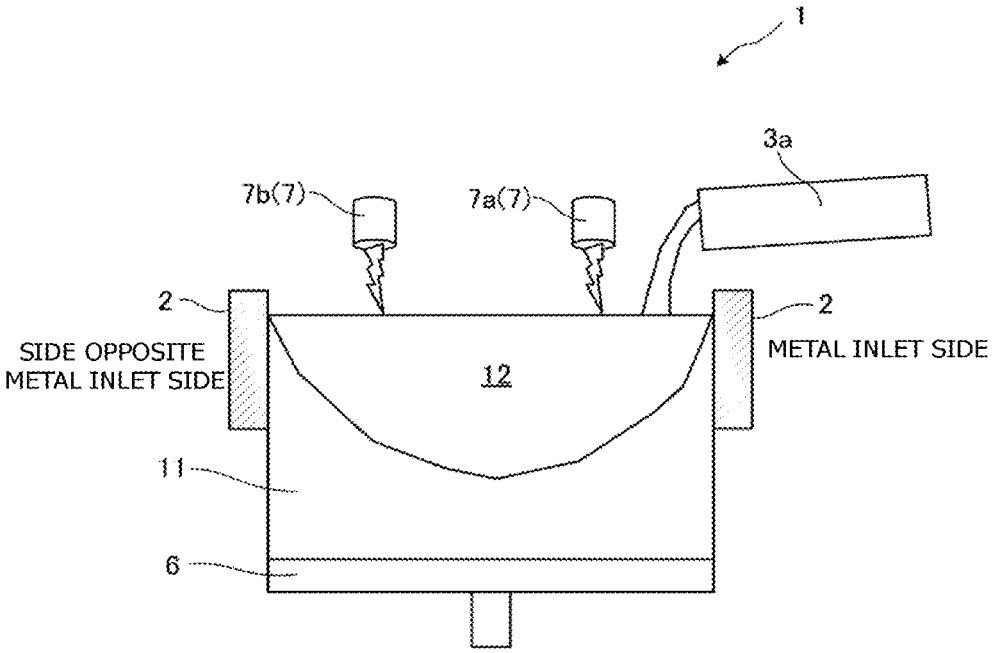
FIG. 2 is a cross-sectional view of the continuous casting machine.

As illustrated in FIG. 1, which is a perspective view, and FIG. 2, which is a cross-sectional view, a continuous casting machine 1 for carrying out the method includes an open mold 2 having a rectangular cross-section. The mold 2 is made of copper and is configured to be cooled by water circulating inside at least inner parts of the walls defining the rectangular opening. The lower opening of the mold 2 can be occupied by a starting block 6, which is raised and lowered by a drive mechanism (not shown).

The continuous casting machine 1 includes a cold hearth 3 from which molten metal 8 is poured into the mold 2. A material feeder (not shown) feeds a raw material of titanium or a titanium alloy such as sponge titanium or titanium scrap into the cold hearth 3. The material in the cold hearth 3 is melted by a plasma arc produced by plasma torches 5 disposed above the cold hearth 3. The cold hearth 3 pours the molten metal 8, which is formed by melting the raw material, at a predetermined flow rate through a pouring lip 3*a* into the mold 2. In the embodiment, the cold hearth 3 is provided on one of the paired shorter sides of the mold 2 and pours the molten metal 8 from the one of the shorter sides of the mold 2 into the mold 2 (pouring step). In FIG. 2, the illustration of the cold hearth 3 is omitted.

The continuous casting machine 1 also includes plasma torches (heat sources) 7, which are disposed above the mold 2 and produce plasma arc. The plasma torches 7 heat the surface of the molten metal 12 in the mold 2 with a plasma arc, while the plasma torches 7 are turned in a horizontal plane over the surface of the molten metal 12 by a moving means (not shown). Movement of the plasma torches 7 is controlled by a controller (not shown).

In the embodiment, in a direction of longer sides of the mold 2, the surface of the molten metal 12 in the mold 2 is divided into the metal inlet side, where the molten metal is poured, and the side opposite the metal inlet side. The surface of the molten metal on the metal inlet side is heated by a first plasma torch (first heat source) 7*a*, which is configured to turn in a horizontal plane over the surface on the metal inlet side, while the surface of the molten metal on the side opposite the metal inlet side is heated by a second plasma torch (second heat source) 7*b*, which is configured to turn in a horizontal plane over the surface of the molten metal on the side opposite the metal inlet side (heating step).

Figure 3:
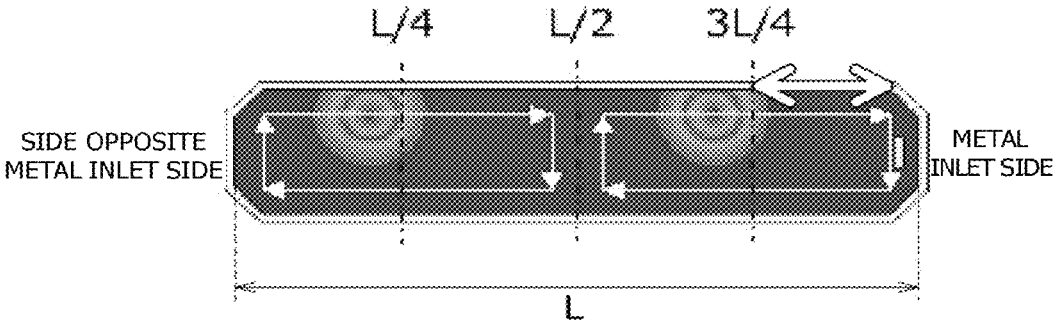
FIG. 3 is a model diagram of a mold viewed from above.

In FIG. 3, which is a model diagram of the mold 2 viewed from above, the paths of turning movement of the first plasma torch 7*a* and the second plasma torch 7*b* are illustrated. As illustrated in FIG. 3, the first plasma torch 7*a* and the second plasma torch 7*b* are turned, for example, horizontally clockwise.

The continuous casting machine 1 is housed in a chamber (not shown) that is filled with inert gas. Thus, the continuous casting machine 1 is surrounded by inert gas such as argon gas or helium gas.

In such configuration, the molten metal 12 in the mold 2 begins to solidify from a surface in contact with the water-cooled mold 2, as illustrated in FIGS. 1 and 2. Then, the starting block 6 that has occupied the lower opening of the mold 2 is lowered at a predetermined rate so that a rectangular prismatic slab 11, which has been formed through solidification of the molten metal 12 is continuously cast while being withdrawn downward.

In the case of electron beam melting in a vacuum, it would be difficult to cast a titanium alloy, because minor components would be evaporated. In contrast, plasma arc melting in an inert gas allows casting of a titanium alloy as well as pure titanium.

The continuous casting machine 1 may include a flux feeder for adding solid or liquid flux to the surface of the molten metal 12 in the mold 2. In the case of electron beam melting in a vacuum, it would be difficult to add the flux to the molten metal 12 in the mold 2, because the flux would be scattered. In contrast, plasma arc melting in an inert gas advantageously allows addition of the flux to the molten metal 12 in the mold 2.

(Cast Surface Defects)

If the surface (cast surface) of a continuously-cast slab 11 containing titanium or a titanium alloy has an irregularity or a flaw, a surface defect occurs in a subsequent rolling process. Thus, it is necessary to remove the irregularity or the flaw on the surface of the slab 11, for example, by cutting before rolling. This causes problems such as decreased yield and increased operations, which are responsible for increased cost. Thus, there exists a need for casting a slab 11 with its cast surface having minimum irregularities and flaws.

Figure 4:
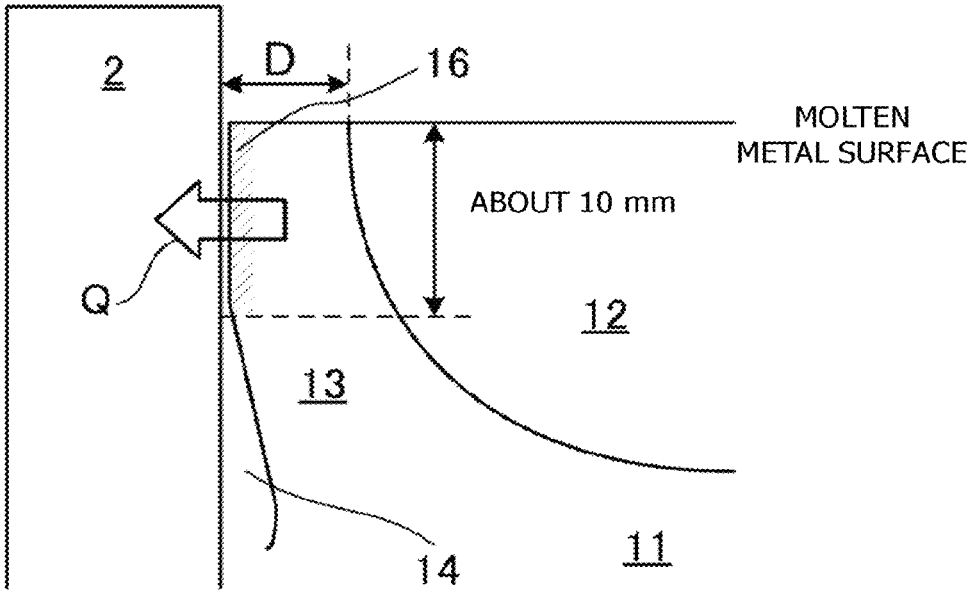
FIG. 4 is a model diagram illustrating a full contact region between the mold and a slab.

In continuous casting of a slab 11, the slab 11 (a solidified shell 13) is in contact with the mold 2 only in a region close to the surface of the molten metal 12 heated by plasma arc (a region extending about 10 mm below from the surface of the molten metal), as illustrated in FIG. 4, which is a model diagram. In a region deeper than the region, the slab 11 is heat-shrunk, which creates an air gap 14 between the mold 2 and the slab 11. The region extending about 10 mm below from the surface of the molten metal is hereinafter referred to as full contact region 16 (the region represented by hatched lines in FIG. 4). In the full contact region 16, a passing heat flux Q is produced from the slab 11 to the mold 2. The symbol "D" in FIG. 4 represents the thickness of the solidified shell 13.

Figure 5A:
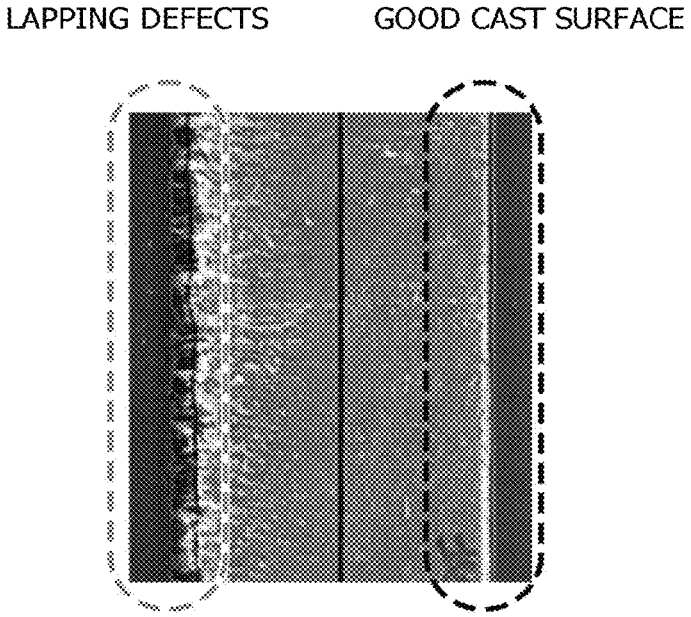
FIG. 5A is a surface photograph of a slab.
Figure 5B:
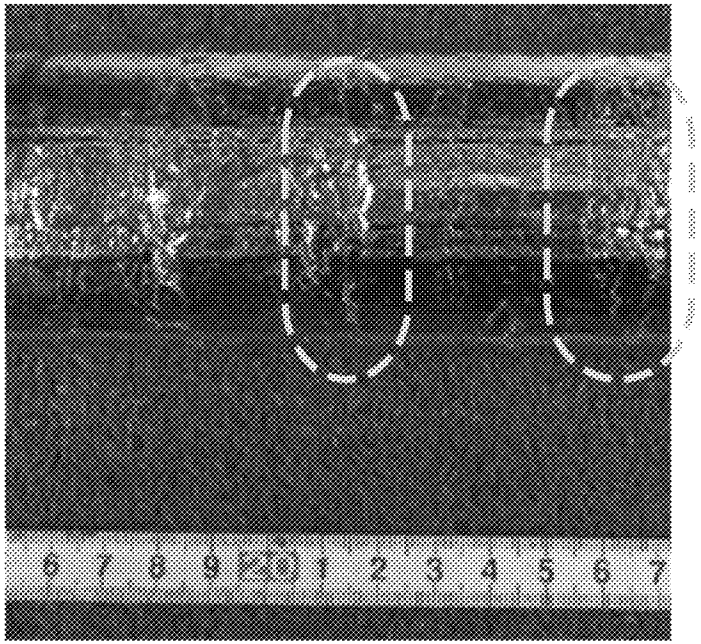
FIG. 5B is a surface photograph of a slab.

If an excessively high heat input is applied to the surface of the molten metal 12, the solidified shell 13 does not grow sufficiently and becomes excessively thin. Thus, the surface of the solidified shell 13 is torn off due to lack of strength. This is called "tear defect". In contrast, if an excessively low heat input is applied to the surface of the molten metal 12, the molten metal 12 is lapped over the overgrown (excessively thickened) solidified shell 13, which causes a large surface defect. This is called a "lapping defect". FIG. 5A is a surface photograph of a slab 11 with a "lapping defect", while FIG. 5B is a surface photograph of a slab 11 with a "tear defect".

(Surface Temperature of Ingot Achieving Acceptable Amount of Irregularities in Cast Surface)

Figure 6:
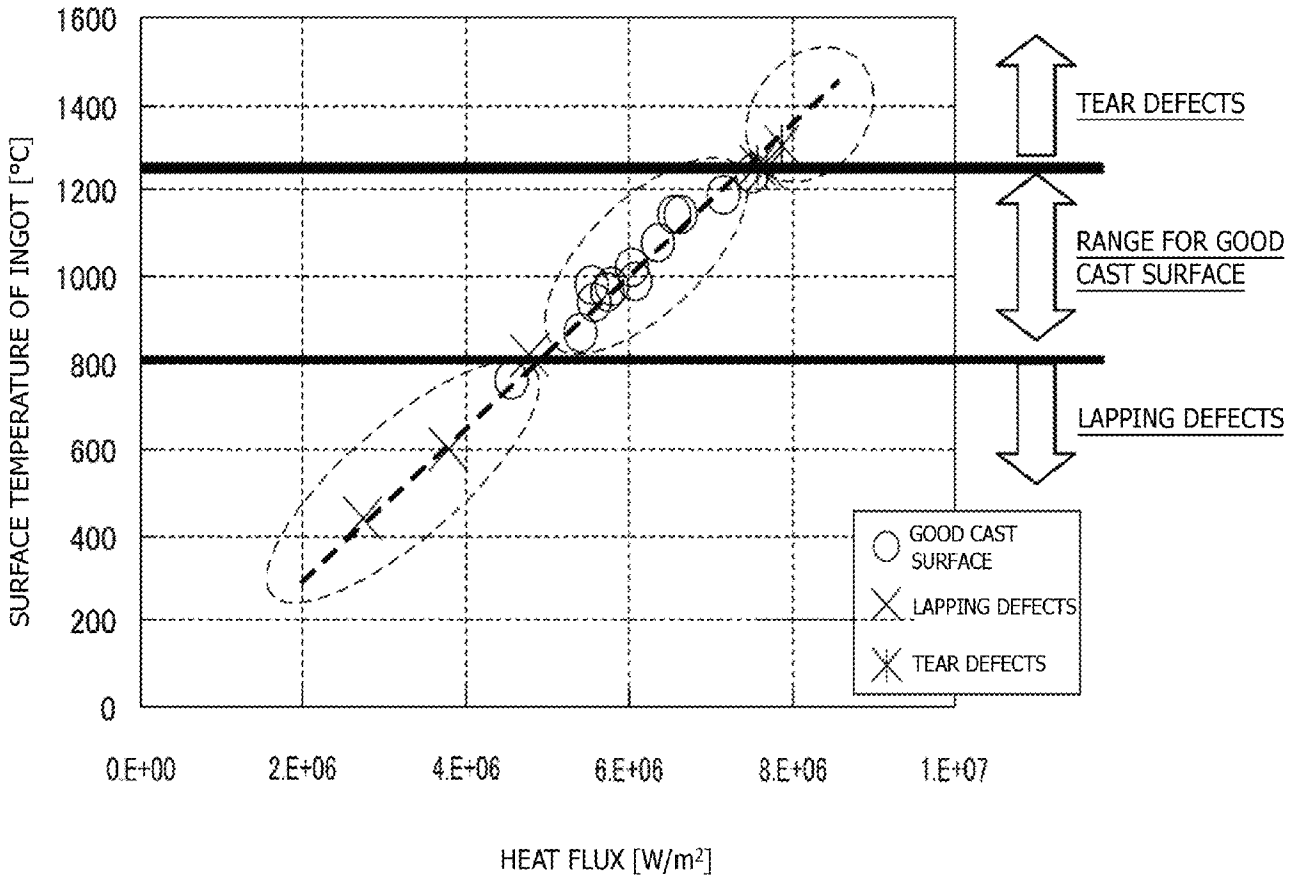
FIG. 6 is a graph illustrating the relationship between passing heat flux and surface temperature of an ingot.

FIG. 6 illustrates the relationship between passing heat flux Q and surface temperature $T_S$ of a slab 11 (surface temperature of an ingot). The passing heat flux Q [W/m$^2$], which is an indicator of heat balance, and the surface temperature $T_S$ [° C.] of the slab 11 are evaluated in terms of an average in the full contact region 16. The relationship diagram shows that if the slab 11 has an average surface temperature $T_S$ in a range from 800° C. to 1250° C. exclusive, in the full contact region 16 between the mold 2 and the slab 11, the resulting slab 11 can have a good cast surface without tear defects or lapping defects.

(Heat Input Conditions)

The inventors thought that when the molten metal is poured from one of the paired shorter sides of the rectangular mold 2 as illustrated in FIG. 1, a surface region on the metal inlet side, the region being not only heated by the heat sources, but also receiving the molten metal 8, would have a higher temperature than the temperature of a surface region on the side opposite the metal inlet side, the region being only heated by the heat sources.

However, study of the cast surface quality of a cast slab 11 has revealed that the surface on the metal inlet side exhibited poorer quality than the surface on the side opposite the metal inlet side. The inventors have found that this is due to the fact that the surface of the molten metal on the metal inlet side has a temperature lower than the temperature of the surface on the side opposite the metal inlet side.

The surface of the molten metal 12 in the mold 2 has a temperature of 2000° C. or higher at the points heated by the heat sources. The surface on the side opposite the metal inlet side has an average temperature from 1900° C. to 2000° C. In contrast, the molten metal 8 poured through the pouring lip 3*a* of the cold hearth 3 into the surface of the molten metal 12 in the mold 2 is presumed to have a temperature near the melting point of the molten titanium or titanium alloy (in the case of pure titanium, the melting point is about 1680° C.), because a thick solidified layer is formed around the periphery of the pouring lip 3*a*. The surface of the molten metal 8 in the cold hearth 3 has an average temperature from 1900° C. to 2000° C. However, the pouring lip 3*a* of the cold hearth 3 has a narrow width and high cooling ability. Thus, when the molten metal 8 is passed through the pouring lip 3*a*, the temperature of the metal 8 is decreased to around the melting point.

Then, the surface on the metal inlet side receives the molten metal 8 having a temperature lower than the average temperature of the surface of the molten metal on the side opposite the metal inlet side, and thus the surface on the metal inlet side has an insufficient heat input. As a result, a solidified shell 13 grows more quickly on the surface of the molten metal along the longer sides of the mold 2 especially on the metal inlet side, whereby the cast surface quality degrades.

Thus, in the embodiment, the first plasma torch 7*a* heats the surface of the molten metal on the metal inlet side in the heating step so that an average amount of heat input q [MW/m$^2$] satisfies the following formulas: $q \geq 0.87$ and $c \leq 11.762q+0.3095$, wherein the average amount of heat input q [MW/m$^2$] is determined from the cycle time c [sec] of turning movement of the first plasma torch 7*a* and the amount of heat input, which is applied by at least the first plasma torch 7*a* to regions of contact between the upper surface of the slab 11 on the metal inlet side and the mold 2. As used herein, the average amount of heat input q is determined by accumulating the amount of heat input applied by at least the first plasma torch 7*a* to the regions of contact between the upper surface of the slab 11 on the metal inlet side and the mold 2, along the path of turning movement of the first plasma torch 7*a*, and dividing the resultant accumulated value by the cycle time c [sec] of turning movement of the first plasma torch 7*a*. The upper region of the slab 11 refers to a surface region containing the molten metal 12 and the solidified shell 13.

Specific means for increasing the temperature of the surface of the molten metal on the metal inlet side can include increasing the output of the first plasma torch 7*a* and changing the path and/or the rate of turning movement of the first plasma torch 7*a*. When such measures are carried out, the temperature of the surface of the molten metal on the metal inlet side can be increased by satisfying the above heat input conditions. This reduces the difference in the temperature/the amount of heat input between the metal inlet side and the side opposite the metal inlet side, and thus the slab 11 can have good cast surface quality over the entire longer side. This allows casting of a slab 11 with a good cast surface.

In the embodiment, as illustrated in FIG. 3, the average amount of heat input q is determined from the amount of heat input, which is applied, while the first plasma torch 7*a* moves around once by turning movement, to the regions of contact between the upper surface of the slab 11 on the metal inlet side and the longer sides of the mold 2, the region located in range from the points about ¾ (3L/4) of the total length of the longer sides of the mold 2 apart from the ends of the longer sides on the side opposite the metal inlet side to the ends of the longer sides of the mold 2 on the metal inlet side, as indicated by a double-headed arrow, wherein L is the length of the longer side of the slab 11 (the longer side of the inner wall of the mold 2). More particularly, the average amount of heat input q is determined by accumulating the amount of heat input, which is applied, while the first plasma torch 7*a* moves around once by turning movement, by at least the first plasma torch 7*a* to the regions of contact between the upper surface of the slab 11 on the metal inlet side and the longer sides of the mold 2 as indicated by the double-headed arrow, along the path of turning movement of the first plasma torch 7*a*, and dividing the resultant accumulated value by the cycle time c [sec] of turning movement of the first plasma torch 7*a*. The surface of the molten metal on the metal inlet side includes the surface of the molten metal at the point 3L/4.

If the first plasma torch 7*a* and the second plasma torch 7*b* are the same in the length of the path of turning movement, and the amount of heat input, which is applied by the second plasma torch 7*b* to the region indicated by the double-headed arrow can be ignored, the average amount of heat input q can be determined only from the amount of heat input, which is applied by the first plasma torch 7*a*. In contrast, if the first plasma torch 7*a* has a path of turning movement that is shorter than the path of turning movement of the second plasma torch 7*b*, and thus the amount of heat input, which is applied by the second plasma torch 7*b* to the region indicated by the double-headed arrow cannot be ignored, the average amount of heat input q can be determined by accumulating the total amount of heat input, which is applied, while the first plasma torch 7*a* moves around once by turning movement, by the first plasma torch 7*a* and the second plasma torch 7*b* to the region indicated by the double-headed arrow, along the path of turning movement of the first plasma torch 7*a*, and dividing the resultant accumulated value by the cycle time c [sec] of turning movement of the first plasma torch 7*a*.

If the average amount of heat input q determined as described above satisfies the heat input conditions described above, the temperature of the surface of the molten metal on the metal inlet side can suitably have an increased temperature.

If the average amount of heat input q determined as described above satisfies the heat input conditions described above in plasma arc melting, in which the surface of the molten metal 12 in the mold 2 is heated by plasma arc, the surface of the molten metal on the metal inlet side can have an increased temperature, and thus the slab 11 can have good cast surface quality over the entire longer side.

(Simulation of Flow Solidification)

Figure 7:
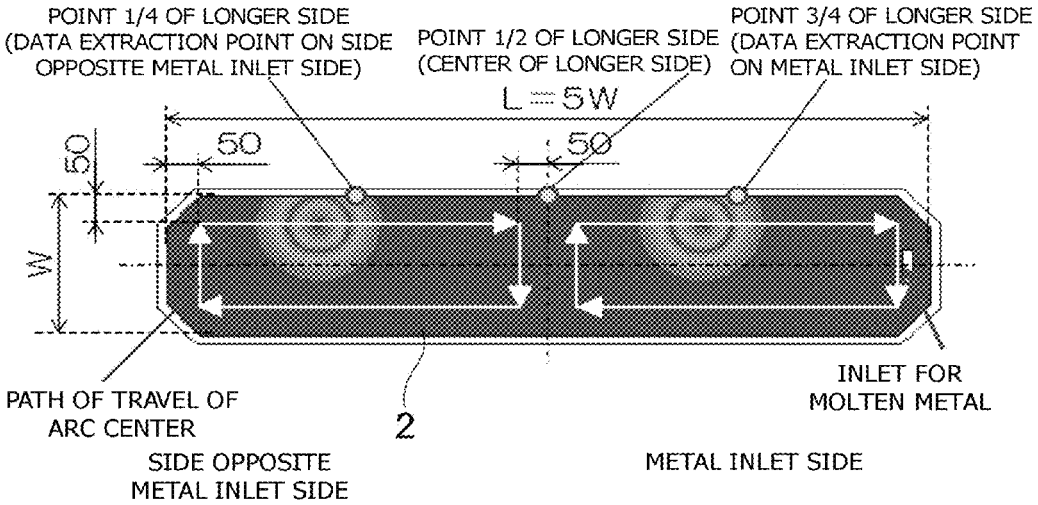
FIG. 7 is a model diagram of the mold viewed from above.

The continuous casting machine 1 according to the embodiment was used to simulate flow solidification in plasma arc melting. In the simulation, the shape of a continuously cast slab 11 having a ratio of the length of the longer side L of the slab 11 (the longer side of the inner wall of the mold 2) to the length of the shorter side W of the slab 11 (the shorter side of the inner wall of the mold 2) 11W of 5 was used, as illustrated in FIG. 7, which is a model diagram of the mold 2 viewed from above.

And a first plasma torch 7*a* for heating the surface of the molten metal on the metal inlet side and a plasma torch 7*b* for heating the surface on the side opposite the metal inlet side were turned horizontally clockwise. Each of the plasma torches 7*a* and 7*b* was turned so that the center of the plasma arc was about 50 mm inside from the inner wall of the mold 2. The molten metal was poured from outside of the path of turning movement of the plasma torch 7*a*.

The actual amount of heat input applied to the surface of the molten metal was defined as $n \cdot \alpha \cdot P$ wherein n was the number of the plasma torches 7, $\alpha$ was efficiency of heat input application by the plasma torches 7, and P was the output [kW] of the plasma torches 7, and then the actual amount of heat input applied to the surface of the molten metal was 440 kW. And the cycle time c was defined as l/v wherein l is the length [mm] of the path of turning movement of the plasma torches 7, and v is the rate of turning movement [mm/sec] of the plasma torches 7, and then the cycle time c was 6.8 seconds.

The plasma torches 7*a* and 7*b* had the same output P, the same rate of turning movement v, and the same path of turning movement. And the plasma torches 7*a* and 7*b* were turned while maintaining a fixed distance between the two plasma torches so that the plasma torches 7*a* and 7*b* applied the same amount of heat input to the metal inlet side and the side opposite the metal inlet side.

The data was collected from a point set near the center of the longer side of the mold 2 (the ½ point of the longer side), a point set about ¼ of the total length of the longer side apart from the end of the longer side on the side opposite the metal inlet side (the ¼ point of the longer side), and a point set about ¾ of the total length of the longer side apart from the end of the longer side on the side opposite the metal inlet side (the ¾ point of the longer side). From the ¼ point of the longer side, data on the side opposite the metal inlet side was collected. From the ¾ point of the longer side, the data on the metal inlet side was collected. From the ½ point of the longer side, the data at the center of the longer side of the mold 2 was collected.

Then, the change over time in the surface temperature $T_S$ [° C.] of the slab 11 (the surface temperature of the ingot) at each of the data collection points was evaluated. The results are illustrated in FIG. 8.

Figure 8:
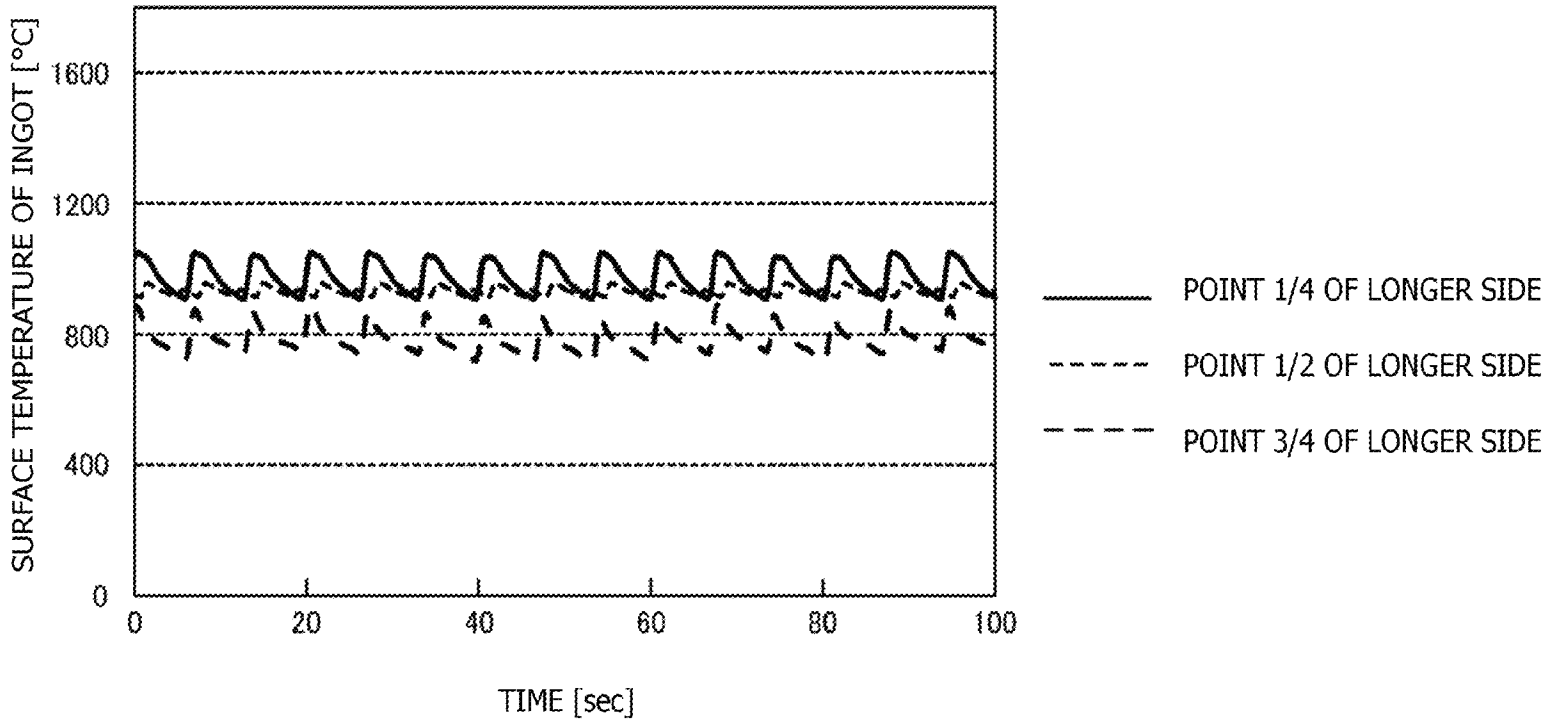
FIG. 8 is a graph illustrating the change over time in surface temperature of an ingot.

FIG. 8 indicates that the ¾ point of the longer side (a data collection point on the metal inlet side) has found to have a decreased surface temperature $T_S$ of the ingot that is outside of the range from 800° C. to 1250° C. exclusive. This may be attributed to the fact that the surface of the molten metal on the side opposite the metal inlet side has an average temperature from about 1900° C. to 2000° C., while the surface on the metal inlet side receives the molten metal having a decreased temperature near the melting point of molten titanium or a molten titanium alloy (in the case of pure titanium, the melting point is about 1680° C.), because the molten metal is poured through the pouring lip 3*a* of the cold hearth 3, and thus the surface on the metal inlet side has an insufficient heat input.

Next, at various increased outputs of the first plasma torch 7*a*, at various paths of turning movement of the first plasma torch 7*a*, and at various rates of turning movement of the first plasma torch 7*a*, the change over time in the surface temperature $T_S$ [° C.] of a slab 11 (surface temperature of an ingot) at the ¾ point of the longer side (a data collection point on the metal inlet side) was evaluated.

In such evaluation, the average amount of heat input q was determined from the amount of heat input, which is applied, while the first plasma torch 7*a* moves around once by turning movement, by at least the first plasma torch 7*a* to the regions of contact between the upper surface of the slab 11 on the metal inlet side and the longer sides of the mold 2, the region as indicated by the double-headed arrow in FIG. 3.

Figure 9:
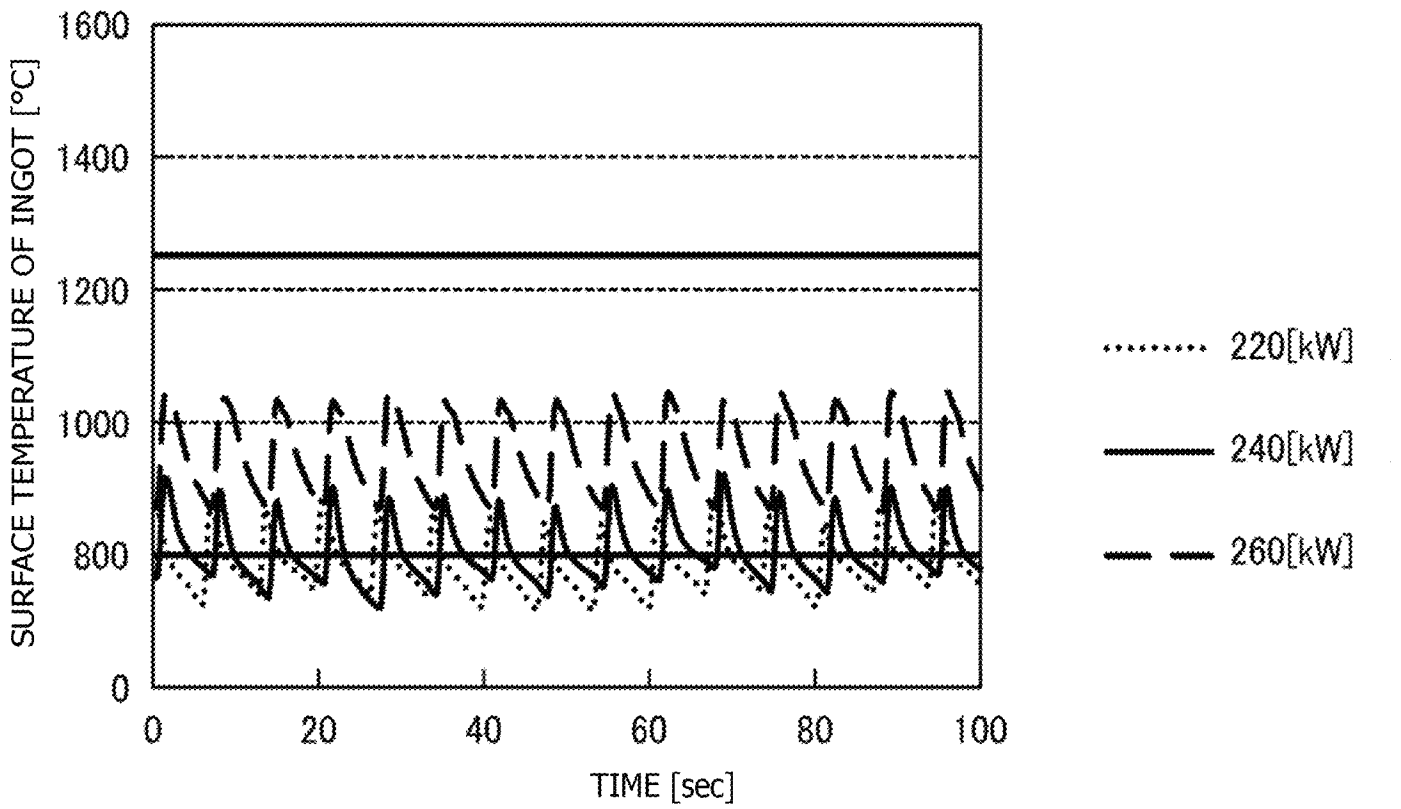
FIG. 9 is a graph illustrating the change over time in surface temperature of an ingot.

The change over time in the surface temperature $T_S$ [° C.] of a slab 11 (surface temperature of an ingot) at the ¾ point of the longer side (a data collection point on the metal inlet side) was evaluated by first increasing the output of the first plasma torch 7*a* and then changing the actual amount of heat input on the metal inlet side to 220 kW, 240 kW, or 260 kW, separately, while the cycle time c was fixed at 6.8 seconds. The results are illustrated in FIG. 9. In the evaluation, the first plasma torch 7*a* and the second plasma torch 7*b* had the same length of the path of turning movement, and thus the amount of heat input applied by the second plasma torch 7*b* to the region indicated by the double-headed arrow could be ignored. Thus, the average amount of heat input q was determined only from the amount of heat input applied only by the first plasma torch 7*a*.

At actual amounts of heat input of 220 kW, 240 kW, and 260 kW, the average amount of heat input q was 0.73 $MW/m^2$, 0.80 $MW/m^2$, and 0.87 $MW/m^2$, respectively. It has been confirmed that the surface temperature $T_S$ of the ingot was within the range from 800° C. to 1250° C. exclusive, at an actual amount of heat input of 260 kW and a cycle time c of 6.8 seconds.

Figure 10A:
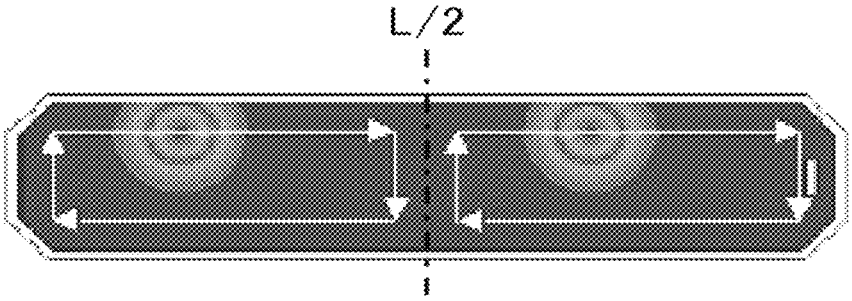
FIG. 10A is a model diagram of the mold viewed from above.
Figure 10B:
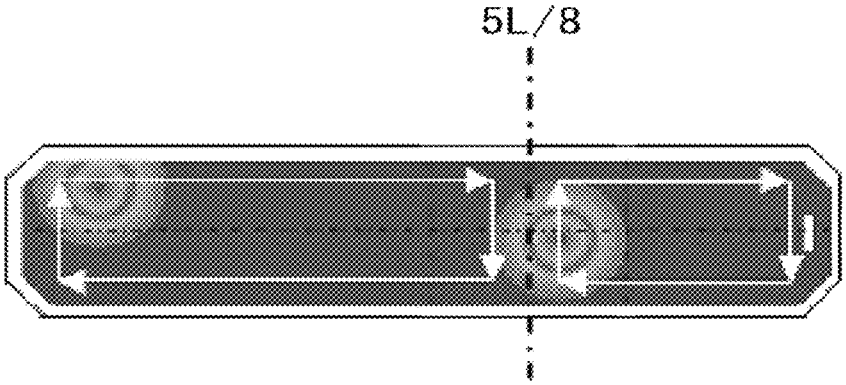
FIG. 10B is a model diagram of the mold viewed from above.
Figure 10C:
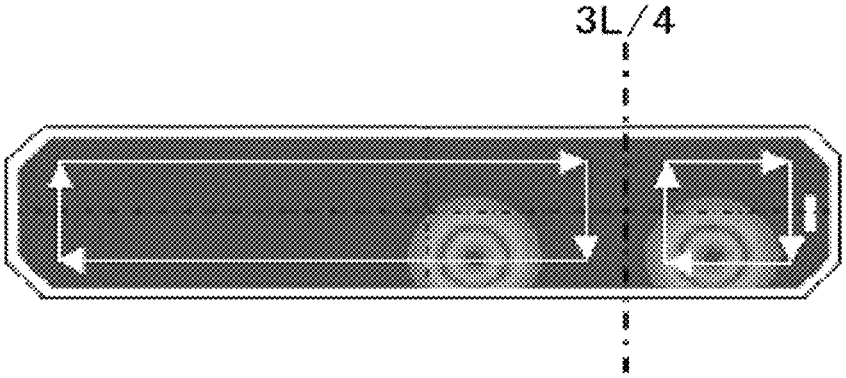
FIG. 10C is a model diagram of the mold viewed from above.

Next, the plasma torches were so constituted that the torches had any of three paths of turning movement illustrated in FIG. 10A to FIG. 10C, a different cycle times c, and a fixed actual amount of applied heat input of 440 kW. Then, the change over time in the surface temperature $T_S$ [° C.] of a slab 11 (surface temperature of an ingot) at the ¾ point of the longer side (a data collection point on the metal inlet side) was evaluated.

Figure 11:
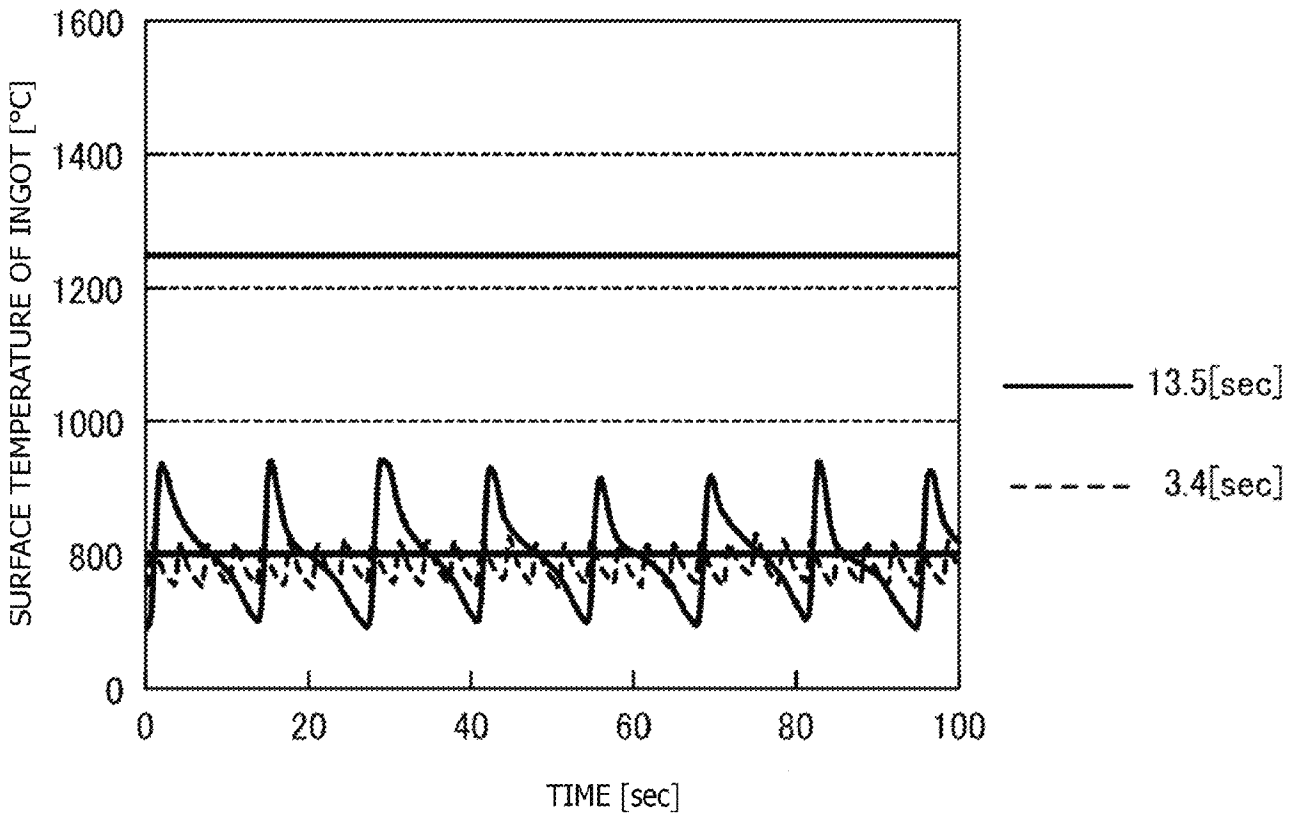
FIG. 11 is a graph illustrating the change over time in surface temperature of an ingot.

In the case of the paths of turning movement illustrated in FIG. 10A, the plasma torches were so constituted that the torches had a cycle time c of 13.5 seconds or 3.4 seconds. As illustrated in FIG. 10A, the boundary between the surface of the molten metal on the metal inlet side and the surface of the molten metal on the side opposite the metal inlet side was located at the point L/2 (the point about ½ of the total length of the longer side of the mold 2 apart from the end of the longer side on the side opposite the metal inlet side toward the metal inlet side), and the first plasma torch 7*a* and the second plasma torch 7*b* had the same length of the path of turning movement. Thus, the amount of heat input applied by the second plasma torch 7*b* to the region indicated by the double-headed arrow was ignored. The results of the evaluation are illustrated in FIG. 11.

The average amount of heat input q was 0.73 $MW/m^2$. FIG. 11 indicates that the surface temperature $T_S$ of the ingot at the ¾ point of the longer side (a data collection point on the metal inlet side) was outside of the range from 800° C. to 1250° C. exclusive, at both cycle times c of 13.5 seconds and 3.4 seconds.

Figure 12:
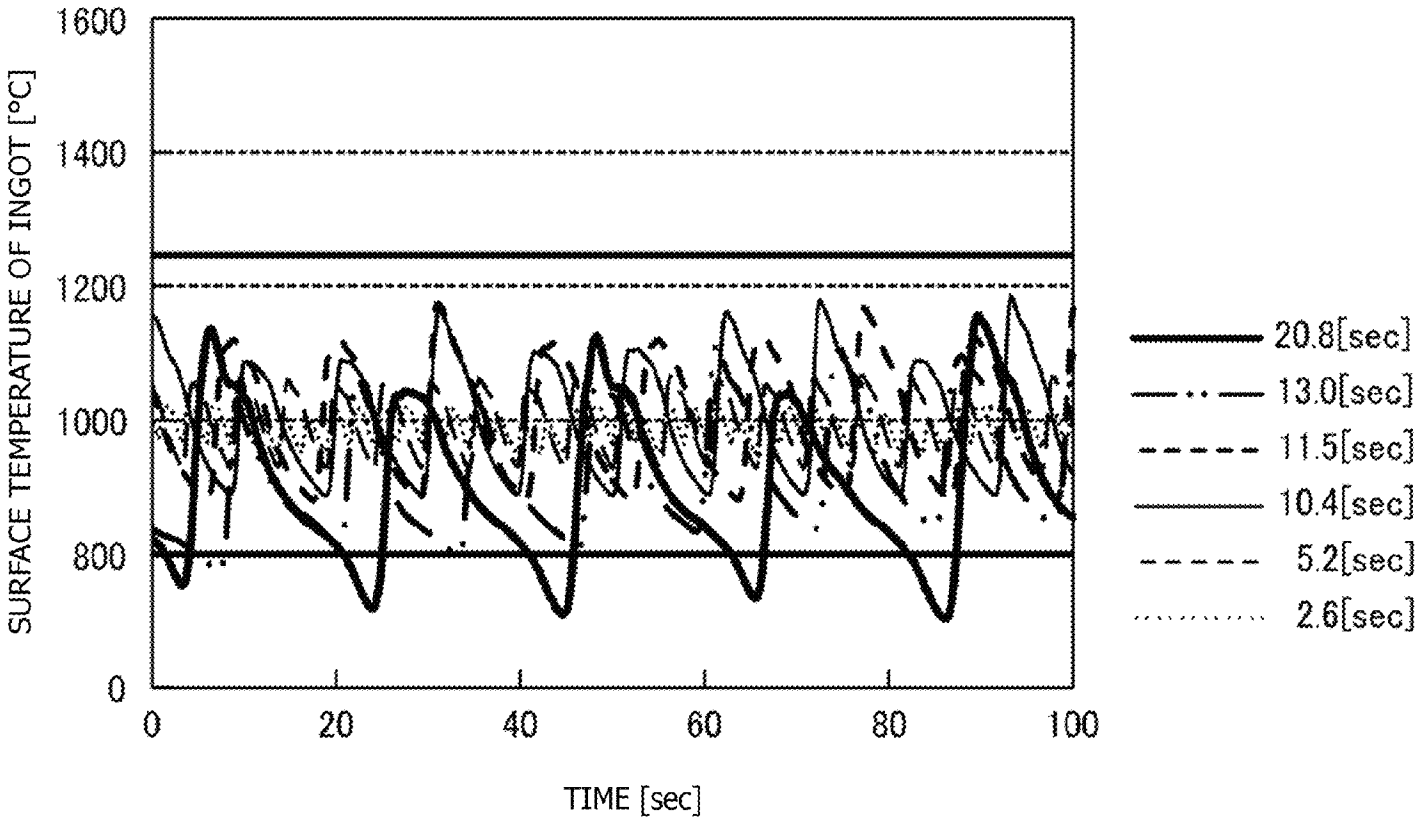
FIG. 12 is a graph illustrating the change over time in surface temperature of an ingot.

Then, the plasma torches were so constituted that the torches had the paths of turning movement illustrated in FIG. 10B and a cycle time c of 20.8 seconds, 13.0 seconds, 11.5 seconds, 10.4 seconds, 5.2 seconds, or 2.6 seconds. As illustrated in FIG. 10B, the boundary between the surface of the molten metal on the metal inlet side and the surface of the molten metal on the side opposite the metal inlet side was located at the point 5L/8 (a point about ⅝ of the total length of the longer side of the mold 2 apart from the end of the longer side on the side opposite the metal inlet side toward the metal inlet side), and the first plasma torch 7*a* had a path of turning movement that is shorter than the path of turning movement of the second plasma torch 7*b*. Thus, the amount of heat input applied by the second plasma torch 7*b* to the region indicated by the double-headed arrow was taken into account to determine the average amount of heat input q. The results of the evaluation are illustrated in FIG. 12.

The average amount of heat input q was 0.95 $MW/m^2$. FIG. 12 indicates that the surface temperature $T_S$ of the ingot at the ¾ point of the longer side (a data collection point on the metal inlet side) was outside of the range from 800° C. to 1250° C. exclusive, at cycle times c of 20.8 seconds and 13.0 seconds. In contrast, it is indicated that the surface temperature $T_S$ of the ingot at the ¾ point of the longer side (a data collection point on the metal inlet side) was within the range from 800° C. to 1250° C. exclusive, at cycle times c of 11.5 seconds, 10.4 seconds, 5.2 seconds, and 2.6 seconds.

Figure 13:
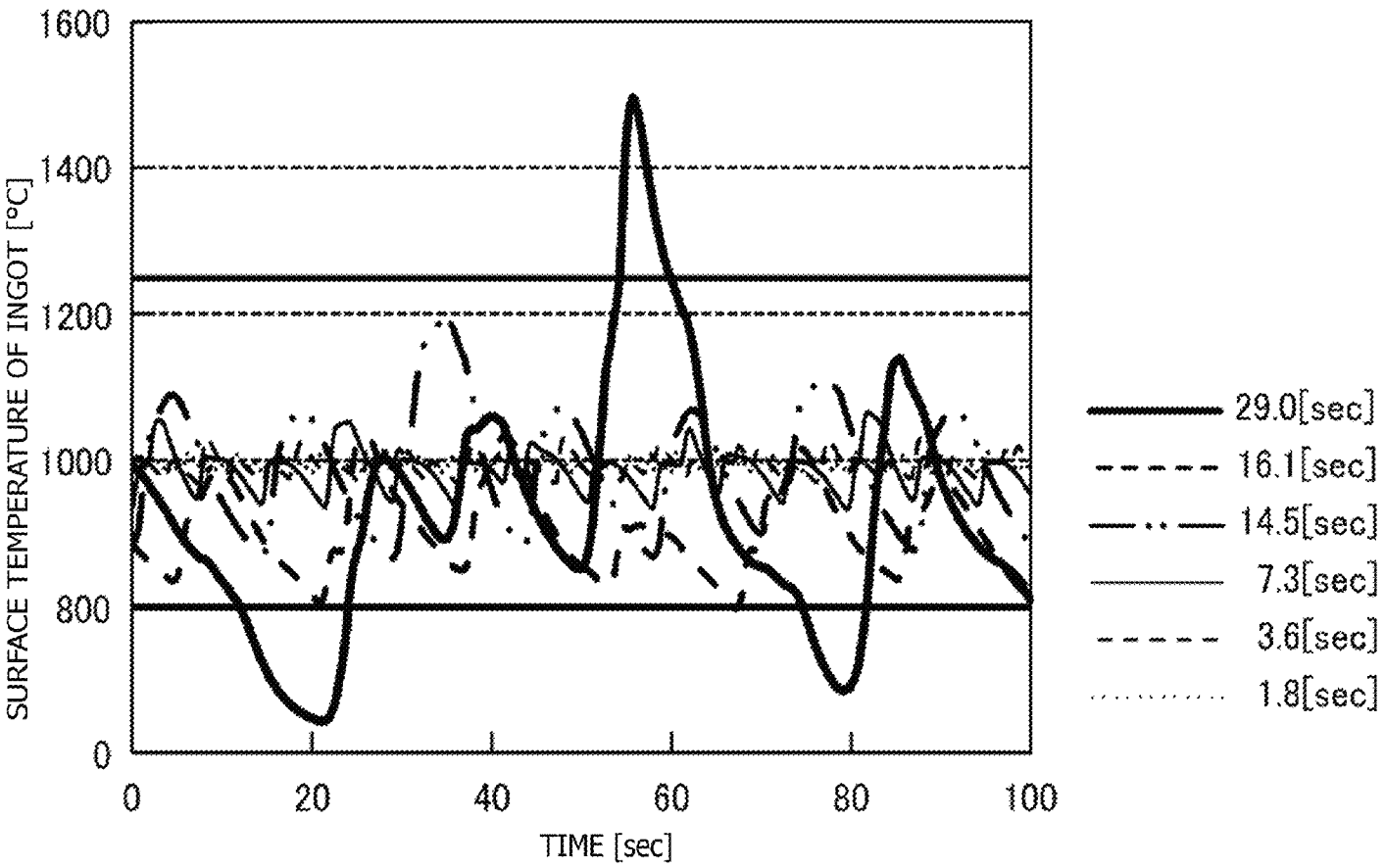
FIG. 13 is a graph illustrating the change over time in surface temperature of an ingot.

Next, the plasma torches were so constituted that the torches had the paths of turning movement illustrated in FIG. 10C and a cycle time c of 29.0 seconds, 16.1 seconds, 14.5 seconds, 7.3 seconds, 3.6 seconds, or 1.8 seconds. As illustrated in FIG. 10C, the boundary between the surface of the molten metal on the metal inlet side and the surface of the molten metal on the side opposite the metal inlet side was located at the point 3L/4 (a point about ¾ of the total length of the longer side of the mold 2 apart from the end of the longer side on the side opposite the metal inlet side toward the metal inlet side), and the first plasma torch 7*a* had an even shorter path of turning movement. Thus, the amount of heat input applied by the second plasma torch 7*b* to the region indicated by the double-headed arrow was taken into account to determine the average amount of heat input q. The results of the evaluation are illustrated in FIG. 13.

The average amount of heat input q was 1.21 $MW/m^2$. FIG. 13 indicates that the surface temperature $T_S$ of the ingot at the ¾ point of the longer side (a data collection point on the metal inlet side) was outside of the range from 800° C. to 1250° C. exclusive, at cycle times c of 29.0 seconds and 16.1 seconds. In contrast, it is indicated that the surface temperature $T_S$ of the ingot at the ¾ point of the longer side (a data collection point on the metal inlet side) was within the range from 800° C. to 1250° C. exclusive, at cycle times c of 14.5 seconds, 7.3 seconds, 3.6 seconds, and 1.8 seconds.

Figure 14:
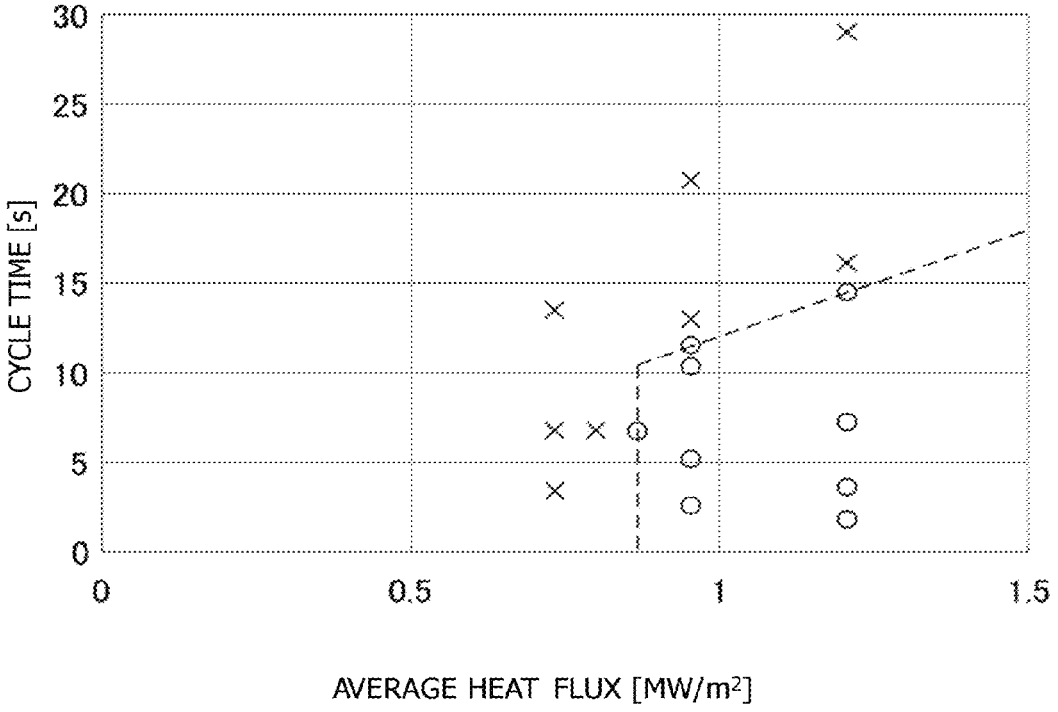
FIG. 14 is a graph illustrating the results of evaluation.

Table 1 and FIG. 14 summarize the above results of the evaluations in terms of surface temperature $T_S$ of an ingot, average amount of heat input q, and cycle time c. In FIG. 14, "○" represents good cast surface quality, and "x" represents poor cast surface quality.

TABLE 1

| | Surface Temperature of Ingot | | Average Amount of Heat Input | Cycle Time | Cast Surface | |
|---|---|---|---|---|---|---|
| | Max. [° C.] | Min. [° C.] | [$MW/m^2$] | [Sec] | Quality | Notes |
| 1 | 878.9 | 702.6 | 0.73 | 6.8 | X | Actual Amount of Heat Input: 220 kW |
| 2 | 921.3 | 720.2 | 0.80 | 6.8 | X | Actual Amount of Heat Input: 240 kW |
| 3 | 1045.3 | 869.8 | 0.87 | 6.8 | ○ | Actual Amount of Heat Input: 260 kW |
| 4 | 941.7 | 690.9 | 0.73 | 13.5 | X | Boundary in Surface of Molten Metal: L/2 |
| 5 | 831.5 | 751.5 | 0.73 | 3.4 | X | Boundary in Surface of Molten Metal: L/2 |
| 6 | 1163.0 | 674.6 | 0.95 | 20.8 | X | Boundary in Surface of Molten Metal: 5L/8 |
| 7 | 1114.3 | 770.4 | 0.95 | 13.0 | X | Boundary in Surface of Molten Metal: 5L/8 |
| 8 | 1171.5 | 861.9 | 0.95 | 11.5 | ○ | Boundary in Surface of Molten Metal: 5L/8 |
| 9 | 1184.9 | 887.1 | 0.95 | 10.4 | ○ | Boundary in Surface of Molten Metal: 5L/8 |
| 10 | 1066.9 | 927.4 | 0.95 | 5.2 | ○ | Boundary in Surface of Molten Metal: 5L/8 |
| 11 | 1021.9 | 947.5 | 0.95 | 2.6 | ○ | Boundary in Surface of Molten Metal: 5L/8 |
| 12 | 1346.1 | 658.1 | 1.21 | 29.0 | X | Boundary in Surface of Molten Metal: 3L/4 |
| 13 | 1034.0 | 797.1 | 1.21 | 16.1 | X | Boundary in Surface of Molten Metal: 3L/4 |
| 14 | 1112.2 | 854.6 | 1.21 | 14.5 | ○ | Boundary in Surface of Molten Metal: 3L/4 |
| 15 | 1064.9 | 932.9 | 1.21 | 7.3 | ○ | Boundary in Surface of Molten Metal: 3L/4 |
| 16 | 1030.9 | 967.3 | 1.21 | 3.6 | ○ | Boundary in Surface of Molten Metal: 3L/4 |
| 17 | 1011.2 | 981.3 | 1.21 | 1.8 | ○ | Boundary in Surface of Molten Metal: 3L/4 |

FIG. 14 indicates that the slab 11 can have good cast surface quality over the entire longer side when the surface on the metal inlet side is heated so that the following formulas: $q \geq 0.87$ and $c \leq 11.762q+0.3095$ are satisfied.

(Effects)

As described above, the method for continuously casting a slab containing titanium or a titanium alloy according to the embodiment includes pouring the molten metal 8 into the mold 2 from one of the paired shorter sides of the mold 2 and heating the surface of the molten metal on the metal inlet side by the first plasma torch 7*a* so that the average amount of heat input q [$MW/m^2$] satisfies the following formulas: $q \geq 0.87$ and $c \leq 11.762q+0.3095$, wherein the average amount of heat input q is determined from the cycle time c [sec] of turning movement of the first plasma torch 7*a* and the amount of heat input, which is applied by the first plasma torch 7*a* to the region of contact between the upper surface of the slab on the metal inlet side and the mold. Specific means for increasing the temperature of the surface of the molten metal on the metal inlet side can include increasing the output of the first plasma torch 7*a* and changing the path and/or the rate of turning movement of the first plasma torch 7*a*. When such measures are carried out, the temperature of the surface of the molten metal on the metal inlet side can be increased by satisfying the above heat input conditions. This reduces the difference in the temperature/the amount of heat input between the metal inlet side and the side opposite the metal inlet side, and thus the slab 11 can have good cast surface quality over the entire longer side. This allows casting of a slab 11 with a good cast surface.

The average amount of heat input q is determined from the amount of heat input, which is applied, while the first plasma torch 7*a* moves around once by turning movement, to the regions of contact between the upper surface of the slab 11 on the metal inlet side and the longer sides of the mold 2, the region located in range from the point about ¾ of the total length of the longer sides of the mold 2 apart from the end of the longer sides on the side opposite the metal inlet side to the end of the longer sides of the mold 2 on the metal inlet side. If the average amount of heat input q determined as described above satisfies the heat input conditions described above, the temperature of the surface of the molten metal on the metal inlet side can suitably have an increased temperature.

If the average amount of heat input q satisfies the heat input conditions described above in plasma arc melting, in which the surface of the molten metal 12 in the mold 2 is heated by plasma arc, the surface of the molten metal on the metal inlet side can have an increased temperature, and thus the slab 11 can have good cast surface quality over the entire longer side.

Modification of Embodiment

Although an embodiment of the present invention has been described, the embodiment is merely for illustrative purposes and not for limitation of the present invention. The specific configurations can be appropriately modified. The functions and the effects described in "Description of the Embodiments" are merely the most suitable functions and effects of the present invention, and the functions and effects of the present invention are not limited to those described in the embodiment of the present invention.

For example, although, in the embodiment, means of increasing the output of the first plasma torch 7*a* and changing the path and/or the rate of turning movement of the first plasma torch 7*a* are exemplified as specific means for increasing the temperature of the surface of the molten metal on the metal inlet side, the distribution of heat input applied by the first plasma torch 7*a* may be changed as long as the above heat input conditions are satisfied.

Although in the above embodiment, heating of the surface of the molten metal 12 in the mold 2 by plasma arc has been described, the present invention is not limited to such configuration, and the surface of the molten metal 12 in the mold 2 may be heated by electron beam. Similarly, the present invention is not limited to the configuration in which the molten metal 8 in the cold hearth 3 is heated by plasma arc, and the metal 8 may be heated by electron beam.

What is claimed is:

1. A method for continuously casting a slab containing titanium or a titanium alloy by pouring molten metal formed by melting titanium or a titanium alloy into an open mold having a rectangular cross-section where the molten metal is solidified and withdrawn from the bottom of the mold, wherein the method includes pouring the molten metal into the mold from one of the paired shorter sides of the mold, and dividing, in a direction of longer sides of the mold, a surface of the molten metal in the mold into a metal inlet side, where the molten metal is poured, and a side opposite the metal inlet side, heating the surface of the molten metal on the metal inlet side of the mold by a first heat source, which is configured to turn in a horizontal plane over the surface of the molten metal on the metal inlet side, and heating the surface of the molten metal on the side opposite the metal inlet side by a second heat source, which is configured to turn in a horizontal plane over the surface of the molten metal on the side opposite the metal inlet side, wherein the surface of the molten metal on the metal inlet side is heated by the first heat source in the heating step so that the following formulas: $q \geq 0.87$ and $c \leq 11.762q + 0.3095$ are satisfied where c is a cycle time [sec] of turning movement of the first heat source, and q is an average amount of heat input [$MW/m^2$] determined by accumulating an amount of heat input, which is applied by at least the first heat source to a region of contact between an upper surface of the slab on the metal inlet side and the mold, along the path of turning movement of the first heat source, and dividing the resultant accumulated value by the cycle time c.

2. The method according to claim 1, wherein:

the surface of the molten metal on the metal inlet side includes a surface of the molten metal, which is located over about ¾ of a total length of the longer sides of the mold from the other shorter side of the mold on the side opposite the metal inlet side; and the average amount of heat input q is determined from the amount of heat input, which is applied, while the first heat source moves around once by turning movement, to regions of contact between the upper surface of the slab on the metal inlet side and the longer sides of the mold, the regions located in ranges from points about ¾ of the length of the longer sides of the mold apart from ends of the longer sides on the side opposite the metal inlet side to ends of the longer sides of the mold on the metal inlet side.

3. The method according to claim 1, wherein the first and second heat sources produce plasma arc.

* * * * *